US011367943B2

(12) United States Patent
Kang et al.

(10) Patent No.: US 11,367,943 B2
(45) Date of Patent: Jun. 21, 2022

(54) PATCH ANTENNA UNIT AND ANTENNA IN PACKAGE STRUCTURE

(71) Applicant: SPREADTRUM COMMUNICATIONS (SHANGHAI) CO., LTD., Shanghai (CN)

(72) Inventors: Kai Kang, Shanghai (CN); Shusheng Guo, Shanghai (CN); Jiewei Lai, Shanghai (CN)

(73) Assignee: SPREADTRUM COMMUNICATIONS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/976,609

(22) PCT Filed: Mar. 26, 2019

(86) PCT No.: PCT/CN2019/079606

§ 371 (c)(1),
(2) Date: Aug. 28, 2020

(87) PCT Pub. No.: WO2020/155345

PCT Pub. Date: Aug. 6, 2020

(65) Prior Publication Data

US 2021/0367323 A1 Nov. 25, 2021

(30) Foreign Application Priority Data

Jan. 31, 2019 (CN) ..... 201910101625.X

(51) Int. Cl.
*H01Q 1/22* (2006.01)
*H01Q 9/04* (2006.01)

(52) U.S. Cl.
CPC ..... *H01Q 1/2283* (2013.01); *H01Q 9/0407* (2013.01)

(58) Field of Classification Search
CPC ..... H01Q 1/12; H01Q 1/22; H01Q 1/2283; H01Q 1/42; H01Q 1/422; H01Q 9/04; H01Q 9/0407; H01Q 9/0414
See application file for complete search history.

(56) References Cited

U.S. PATENT DOCUMENTS 5,270,722 A 12/1993 Delestre
6,104,347 A 8/2000 Snygg et al.
(Continued)

FOREIGN PATENT DOCUMENTS

CN 1489804 A 4/2004
CN 1905276 A 1/2007
(Continued)

OTHER PUBLICATIONS

International Search Report for International Application No. PCT/CN2020/079606; dated, Nov. 11, 2019.
(Continued)

*Primary Examiner* — Jason Crawford
(74) *Attorney, Agent, or Firm* — Cantor Colburn LLP

(57) ABSTRACT

A patch antenna unit and an Antenna in Package (AIP) structure are provided. The patch antenna unit includes: a base substrate; multiple layers of patches stacked on the base substrate, wherein an isolation layer is disposed between adjacent layers of the patches, and configured to generate a radio frequency electromagnetic field, wherein an edge shape of at least one layer in the multiple layers of patches is a continuous and smooth function curve shape, and edge shapes of all sides of a same layer in the multiple layers of patches are a same function curve shape. Impedance bandwidth may be increased while symmetry of the antenna structure is maintained, and requirements of a substrate process are met, thereby increasing operation bandwidth of the AiP structure.

3 Claims, 9 Drawing Sheets

(56) References Cited

U.S. PATENT DOCUMENTS

| | | | | |
|---|---|---|---|---|
| 8,847,825 | B2 * | 9/2014 | Schadler | H01Q 9/0435 343/700 MS |
| 9,112,260 | B2 * | 8/2015 | Chakravarty | H01Q 9/045 |
| 2001/0050638 | A1 * | 12/2001 | Ishitobi | H01Q 9/0442 343/846 |
| 2004/0061648 | A1 | 4/2004 | Pros et al. | |
| 2005/0110685 | A1 * | 5/2005 | Frederik du Toit | H01Q 19/005 343/770 |
| 2007/0024511 | A1 * | 2/2007 | Li | H01Q 9/0428 343/700 MS |
| 2007/0274511 | A1 | 2/2007 | Li et al. | |
| 2008/0036665 | A1 * | 2/2008 | Schadler | H01Q 9/0435 343/700 MS |
| 2008/0204326 | A1 * | 8/2008 | Zeinolabedin Rafi | H01Q 9/0428 343/700 MS |
| 2010/0315311 | A1 | 12/2010 | Touchard | |
| 2012/0212376 | A1 | 8/2012 | Jan et al. | |
| 2014/0361952 | A1 * | 12/2014 | Dobric | H01Q 21/00 343/893 |
| 2019/0020110 | A1 * | 1/2019 | Paulotto | H01Q 9/0414 |
| 2020/0021037 | A1 * | 1/2020 | Wu | H01Q 9/0457 |
| 2020/0161766 | A1 | 5/2020 | Liu et al. | |
| 2020/0313299 | A1 * | 10/2020 | Jia | H01Q 9/0457 |
| 2021/0367323 | A1 * | 11/2021 | Kang | H01Q 1/22 |

FOREIGN PATENT DOCUMENTS

| | | | |
|---|---|---|---|
| CN | 101136503 | A | 3/2008 |
| CN | 204067574 | U | 12/2014 |
| CN | 105226390 | A | 1/2016 |
| CN | 206040981 | U | 3/2017 |
| CN | 106887682 | A | 6/2017 |
| CN | 206412483 | U | 8/2017 |
| CN | 108879114 | A | 11/2018 |
| EP | 1358696 | A1 | 11/2003 |
| WO | 02063714 | A1 | 8/2002 |
| WO | 2008148569 | A2 | 12/2008 |
| WO | 2009016071 | A1 | 2/2009 |

OTHER PUBLICATIONS

CNIPA 1st Office Action for corresponding CN Application No. 201910101625.X; dated Jan. 6, 2021.

Silvia et al., "Using a Multilayer Perceptrons for Accurate Modeling of Quasi-Fractal Patch Antennas", International Workshop on Antenna Technology (iWAT); Mar. 2010, pp. 1-4, IEEE.

* cited by examiner

PATCH ANTENNA UNIT AND ANTENNA IN PACKAGE STRUCTURE

CROSS-REFERENCE TO RELATED APPLICATIONS

This application is the national stage of International Application No. PCT/CN2019/079606, filed on Mar. 26, 2019, Priority under 35 U.S.C. § 119(a) and 35 U.S.C. § 365(b) is claimed from Chinese Patent Application No. 201910101625.X, filed on Jan. 31, 2019, and entitled "PATCH ANTENNA UNIT AND ANTENNA IN PACKAGE STRUCTURE", the entire disclosure of which is incorporated herein by reference.

TECHNICAL FIELD

The present disclosure generally relates to antenna technology field, and more particularly, to a patch antenna unit and an antenna in package structure.

BACKGROUND

The 5-th Generation (5G) communication technology new radio standard defines multiple millimeter wave frequency bands. For example, a sum of frequency bands N258 and N257 in China, the United States, Japan, Korea, Europe and other regions is 24.25 GHz to 29.5 GHz, and a bandwidth relative to its center frequency is about 20%. If specified frequency bands in different regions of the world need to be compatible in a system, a wideband antenna is required. Referring to FIG. 1, in existing techniques, to meet various technical requirements of millimeter wave mobile communication, Antenna in Package (AiP) of a transceiver chip (TRX RFIC) integrated with an antenna array is employed, which is most conducive to realizing functions and performance of a millimeter wave front end single chip or module and are applied in mobile terminals and various miniaturized devices. The existing AiP technology uses a patch antenna as a unit of a planar array. An existing AiP structure includes a substrate, and a multi-layer patch (M1-M6) and a multi-layer dielectric isolation layer (D1-D6) above the substrate.

Generally, a relative bandwidth of a patch antenna is about 5%, and a relative bandwidth of a multi-layer patch antenna with a thick substrate is not greater than 15%. As shown in FIG. 2, existing AiP structures have poor return loss characteristic in frequency bands below 27 GHz, and it is difficult to be compatible with frequency bands in different regions of the world. In addition, a bandwidth of the antenna increases with the increase of thickness of the substrate. Therefore, in the existing techniques, a multi-layer complex substrate is employed, and even air cavities are made under antenna units for some AiPs. This requires special processes and high cost, but radio frequency performance does not meet requirements. Therefore, it is difficult to meet industrial design requirements of slim mobile terminals.

Therefore, a new patch antenna unit and an AiP structure are needed to increase antenna bandwidth and reduce cost.

SUMMARY

To increase antenna bandwidth and reduce cost, embodiments of the present disclosure provide a patch antenna unit, including: a base substrate or a printed circuit board; multiple layers of patches stacked on the base substrate or the printed circuit board, wherein an isolation layer is disposed between adjacent layers of the patches, and configured to generate a radio frequency electromagnetic field, wherein an edge shape of at least one layer in the multiple layers of patches is a function curve shape.

Optionally, edge shapes of all sides of a same layer in the multiple layers of patches are a same function curve shape.

Optionally, edge shapes of a pair of opposite sides of a same layer in the multiple layers of patches are a same function curve shape.

Optionally, edge shapes of sides of different layers in the multiple layers of patches are different function curve shapes.

Optionally, a function curve corresponding to the function curve shape is a trigonometric function curve.

Optionally, a function curve corresponding to the function curve shape is $y=A\sin(n\cdot 2\pi\cdot x/W)$, where W is a side length of an original rectangular patch, A is an amplitude of extension of a preset curve, and n is the number of cycles that the curve changes with edges of the patch.

Optionally, a function curve corresponding to the function curve shape is $y=A\sin(n\cdot 2\pi\cdot x/W)$, where W is a side length of an original rectangular patch, A is an amplitude of extension of a preset curve, and n is the number of cycles that the curve changes with edges of the patch.

Optionally, a function curve corresponding to the function curve shape is a parabola.

Optionally, a function curve corresponding to the function curve shape is a hyperbola.

Embodiments of the present disclosure further provide an AiP structure, which includes a plurality of the above patch antenna units, and further includes: probes configured to feed power to a bottom patch of the plurality of patch antenna units; and a transceiver chip electrically connected to the plurality of patch antenna units through the probe, and configured receive or transmit signals within a preset frequency range.

Embodiments of the present disclosure may provide following advantages.

In the embodiments of the present disclosure, the patch antenna unit includes: a base substrate; multiple layers of patches stacked on the base substrate, wherein an isolation layer is disposed between adjacent layers of the patches, and configured to generate a radio frequency electromagnetic field, wherein an edge shape of at least one layer in the multiple layers of patches is a continuous and smooth function curve shape, and edge shapes of all sides of a same layer in the multiple layers of patches are a same function curve shape. Impedance bandwidth may be increased while symmetry of the antenna structure is maintained, and requirements of a substrate process are met, thereby increasing operation bandwidth of the AiP structure.

Further, edge shapes of sides of different layers in the multiple layers of patches are different function curve shapes, which may generate multiple resonance modes, increase operation bandwidth. Edge shapes of the patches being determined through functions may provide more design flexibility for manufacturers so as to optimize performance of antennas.

DETAILED DESCRIPTION

Figure 1:
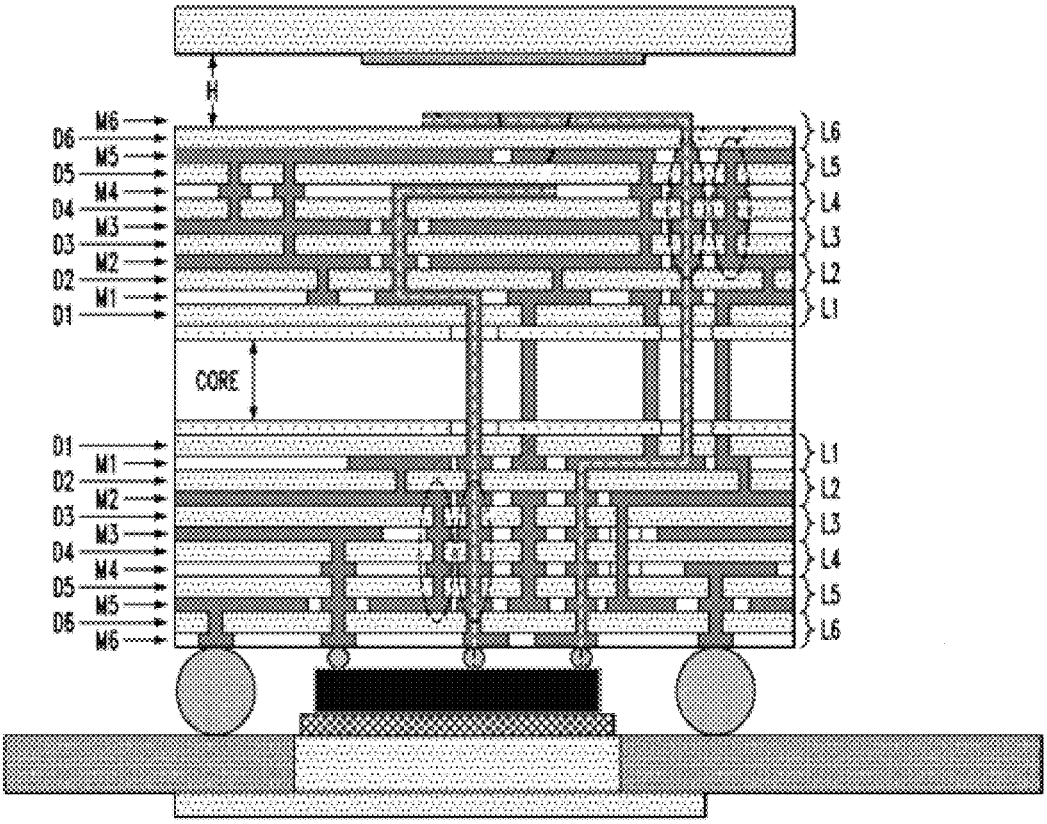
FIG. 1 (prior art)
FIG. 1 is a diagram of an AiP structure in existing techniques.
Figure 2:
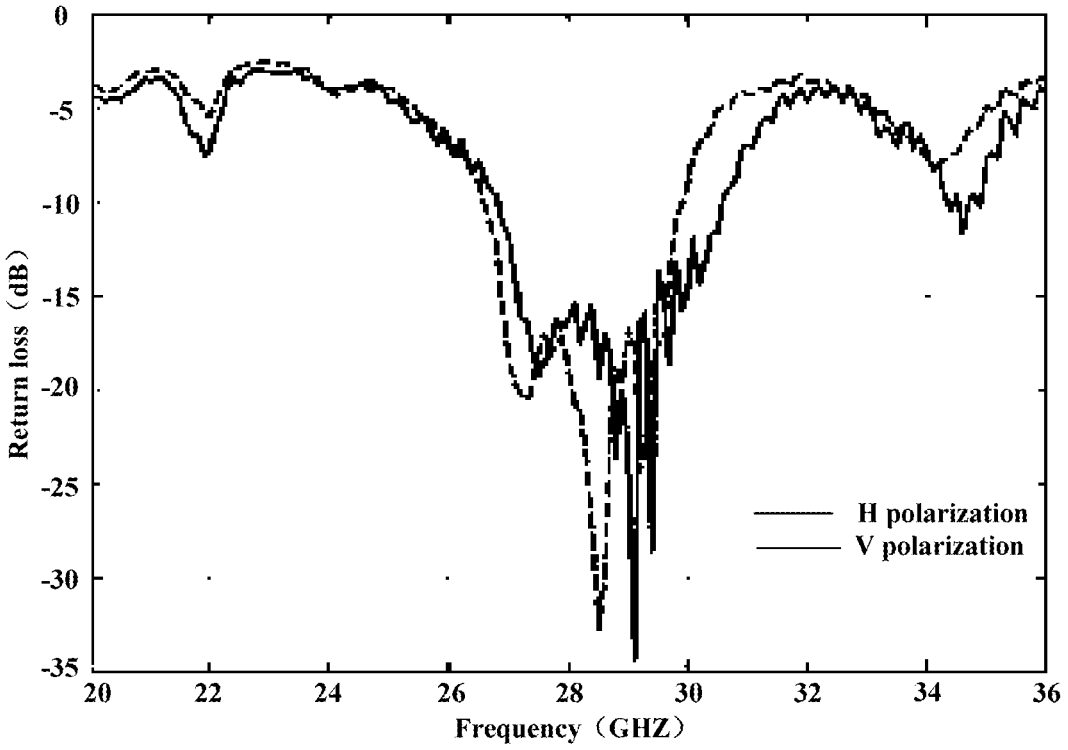
FIG. 2 (prior art)
FIG. 2 is a diagram illustrating wideband impedance characteristic of an AiP structure in existing techniques.
Figure 3:
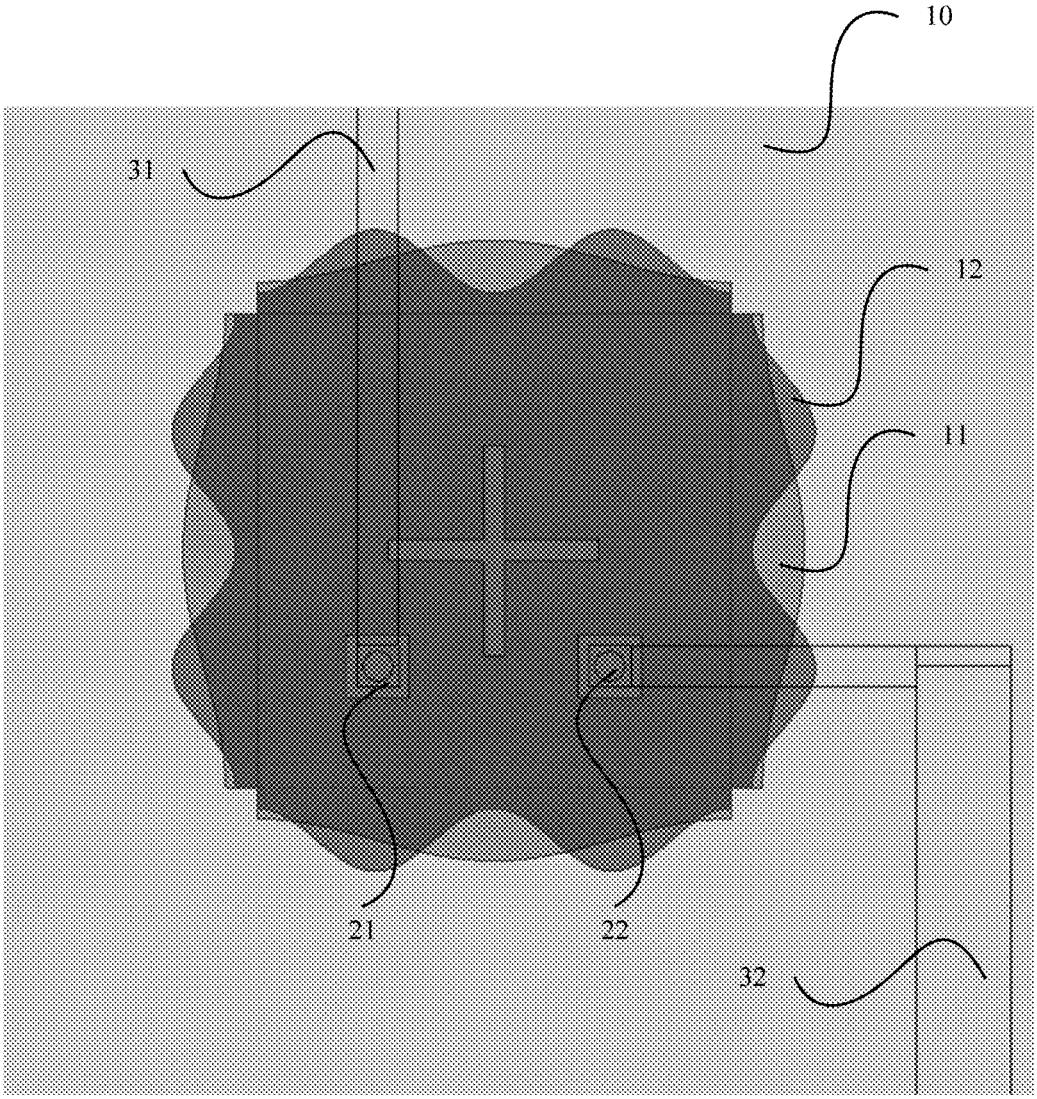
FIG. 3 is a structural diagram of a patch antenna unit according to an embodiment.

Referring to FIG. 3, FIG. 3 is a structural diagram of a patch antenna unit according to an embodiment.

The patch antenna unit includes: a base substrate or a printed circuit board; multiple layers of patches stacked on the base substrate or the printed circuit board, wherein an isolation layer is disposed between adjacent layers of the patches, and configured to generate a radio frequency electromagnetic field, wherein an edge shape of at least one layer in the multiple layers of patches is a function curve shape. In the embodiments below, take the multiple layers of patches being stacked on a base substrate 10 for example.

The number of layers of patches in the patch antenna unit shown in FIG. 3 is two, the patches including a first patch 11 and a second patch 12. In addition, FIG. 3 also shows a first probe 21, a second probe 22, and a first feeder 31 and a second feeder 32 respectively connected thereto.

It should be noted that the configuration of dual probes in the embodiment can meet a requirement of dual polarization of antenna. Therefore, edge shapes of all sides of a same patch are a same function curve shape. Alternatively, in some embodiments, if only single polarization is required, merely one probe needs to be provided in the AiP structure, and edge shapes of a pair of opposite sides of a same patch are a same function curve shape. This design can also maintain symmetry of the antenna structure and meet requirements of a substrate process.

In the exiting techniques, according to a cavity or a transmission line model of microstrip patch antennas, performance of a patch, such as impedance and radiation, depends on an equivalent magnetic current formed by an electric field distribution at radiation edges. Generally, increasing thickness of a substrate can effectively improve impedance bandwidth of the antenna. However, a thick substrate in a millimeter wave frequency band may bring relatively large surface wave loss, and thickness h of the substrate used as a substrate in AiP should generally not exceed one tenth of $\lambda_0$ to meet various requirements of chip packaging. Therefore, the method of increasing the thickness of the substrate to increase the bandwidth of the antenna is limited.

In the embodiments of the present disclosure, an edge shape of each side of the multiple layers of patches is a function curve shape, more specifically, being a continuous and smooth function curve shape. With this design, a tangential electric field distribution of radiation edges is effectively expanded, which enhances its contribution to radiation, thereby increasing bandwidth of the antenna and further increasing impedance bandwidth of the patch antenna unit. By optimizing selected function parameters, a field in an orthogonal direction of the radiation edge may be controlled so as not to produce a large cross-polarized field. The above solution makes great changes to the existing techniques that simply relies on increasing the thickness of the substrate or using more expensive low-permittivity materials to increase bandwidth, and does not require parasitic elements in an array plane to save an area.

In some embodiments, a function curve corresponding to the function curve shape is a trigonometric function curve. In some embodiments, the function curve corresponding to the function curve shape is a parabola or a hyperbola.

In some embodiments, edge shapes of sides of different layers in the multiple layers of patches are different function curve shapes. For example, in one embodiment, the patch antenna unit may include two layers of patches, and the edge shapes of the two layers of patches may be parabolic and hyperbolic respectively.

By using different function curves on different layers of patches to form shapes of edges of the patches, multiple resonance modes can be generated. These modes are close to degeneracy in the case of relatively smooth and continuous curves, that is, resonance frequencies are close so as to increase bandwidth of the patch unit. Besides, such a structure can still maintain good symmetry, which is beneficial to the realization of simultaneous dual polarization or circular polarization.

Figure 4:
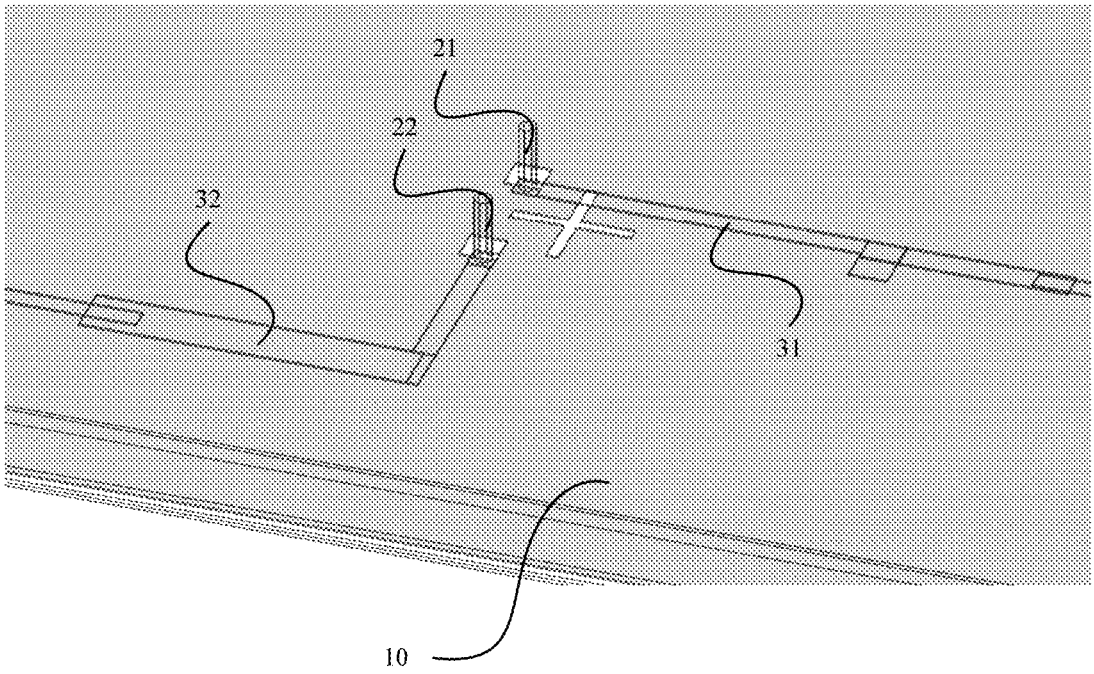
FIG. 4 is a structural diagram of a portion of a patch antenna unit according to an embodiment.
Figure 5:
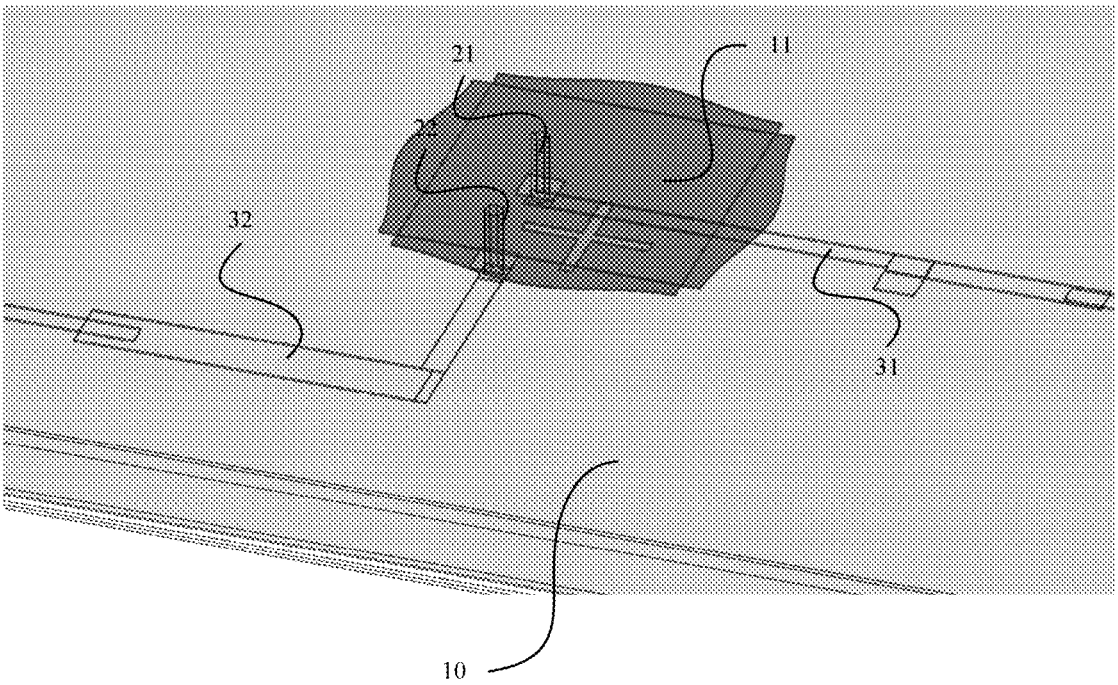
FIG. 5 is a structural diagram of a portion of a patch antenna unit according to an embodiment.
Figure 6:
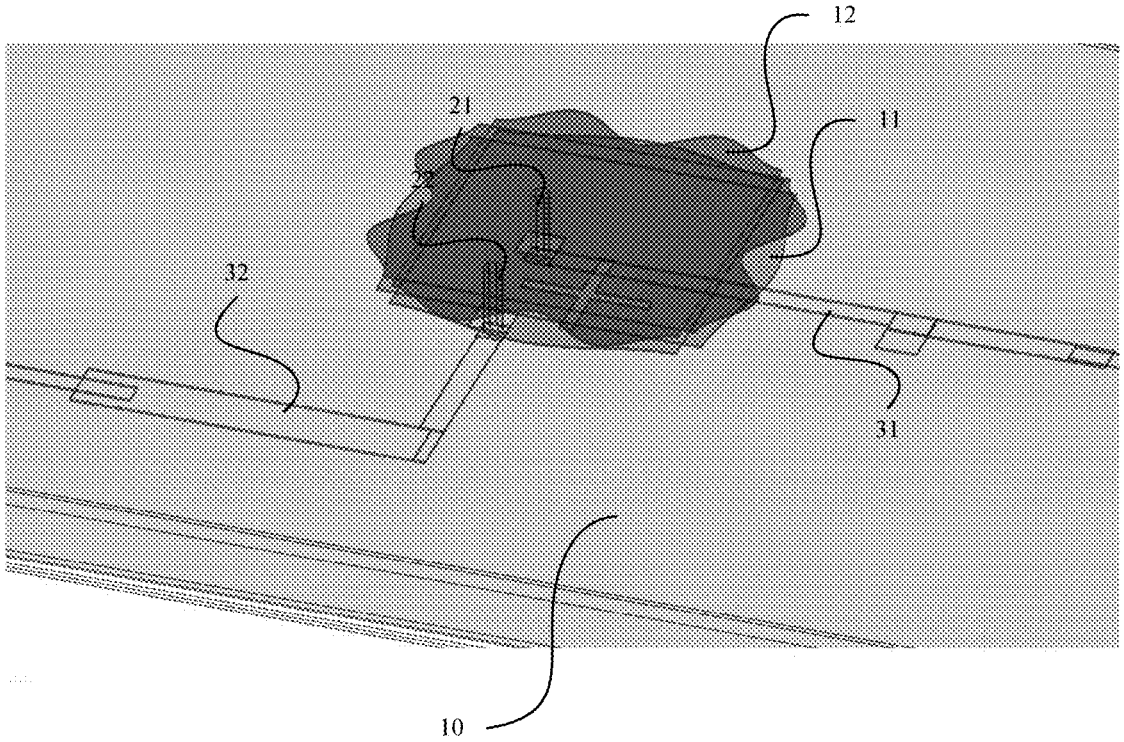
FIG. 6 is a structural diagram of a portion of a patch antenna unit according to an embodiment.

Specifically, referring to FIG. 4 to FIG. 6, FIG. 4 to FIG. 6 are structural diagrams of portions of a patch antenna unit according to embodiments.

FIG. 4 illustrates the substrate 10 of the patch antenna unit, the first probe 21, the second probe 22, and the first feeder 31 and the second feeder 32 respectively connected thereto.

In some embodiments, the first feeder 31 and the second feeder 32 are connected to ports of a transceiver chip in the AiP structure and are arranged below the substrate 10. An upper surface of the substrate 10 is further provided with a metal ground plane which serves as a ground reflection surface of patches. The metal ground plane also isolates parasitic radiation of the feeders, reduces the impact on array beams, and also reduces coupling interference of the antenna to the transceiver chip.

In FIG. 5, the first probe 21 and the second probe 22 are respectively electrically connected to the first patch 11 on a bottom layer, and feed power to the first patch 11 to excite a radio frequency electromagnetic field.

In some embodiments, each side of the first patch 11 has a same shape, and the corresponding function curve is $$y=A\sin(n\cdot 2\pi\cdot x/W),$$

where W is a side length of an original rectangular patch, A is an amplitude of extension of a preset curve, and n is the number of cycles that the curve changes with edges of the patch.

Edge shapes of the patches being determined through functions may provide more design flexibility for manufacturers so as to optimize performance of antennas.

As shown in FIG. 6, each side of the second patch 12 on an upper layer has a same shape, and the corresponding function curve is $$y=A\sin(n\cdot 2\pi\cdot x/W),$$

where W is a side length of an original rectangular patch, A is an amplitude of extension of a preset curve, and n is the number of cycles that the curve changes with edges of the patch.

In some embodiments, the second patch 12 is not directly connected to the first probe 21 and the second probe, but is coupled and fed by the first patch 11 in the lower layer.

Figure 7:
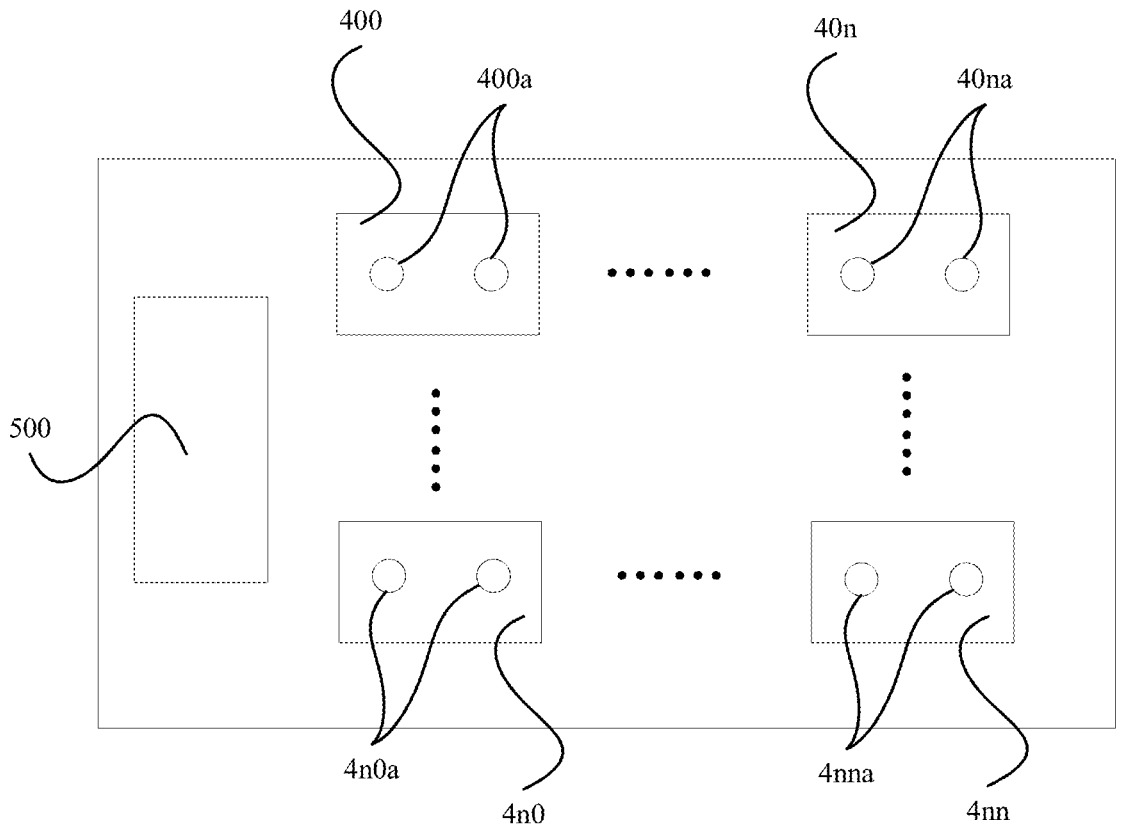
FIG. 7 is a diagram of an AiP structure according to an embodiment.

FIG. 7 is a diagram of an AiP structure according to an embodiment. The AiP structure includes a plurality of patch antenna units (400-4*nn*), and further includes: probes (400*a*-4*nna*), configured to feed power to a bottom patch of the plurality of patch antenna units (400-4*nn*); and a transceiver chip 500 electrically connected to the plurality of patch antenna units (400-4*nn*) via the probes (400*a*-4*nna*), and configured to receive or transmit signals within a preset frequency range.

In some embodiments, the number of the bottom layer patch may be one or more. In some embodiments, the transceiver chip 500 is disposed at the bottom of the AiP and connected to the substrate above it via a solder bump. In some embodiments, the transceiver chip 500 may be disposed on any side of the substrate in the AiP, and its position may be the center of the substrate or other positions relative to the center of the substrate. The specific position of the transceiver chip 500 is not limited.

Figure 8:
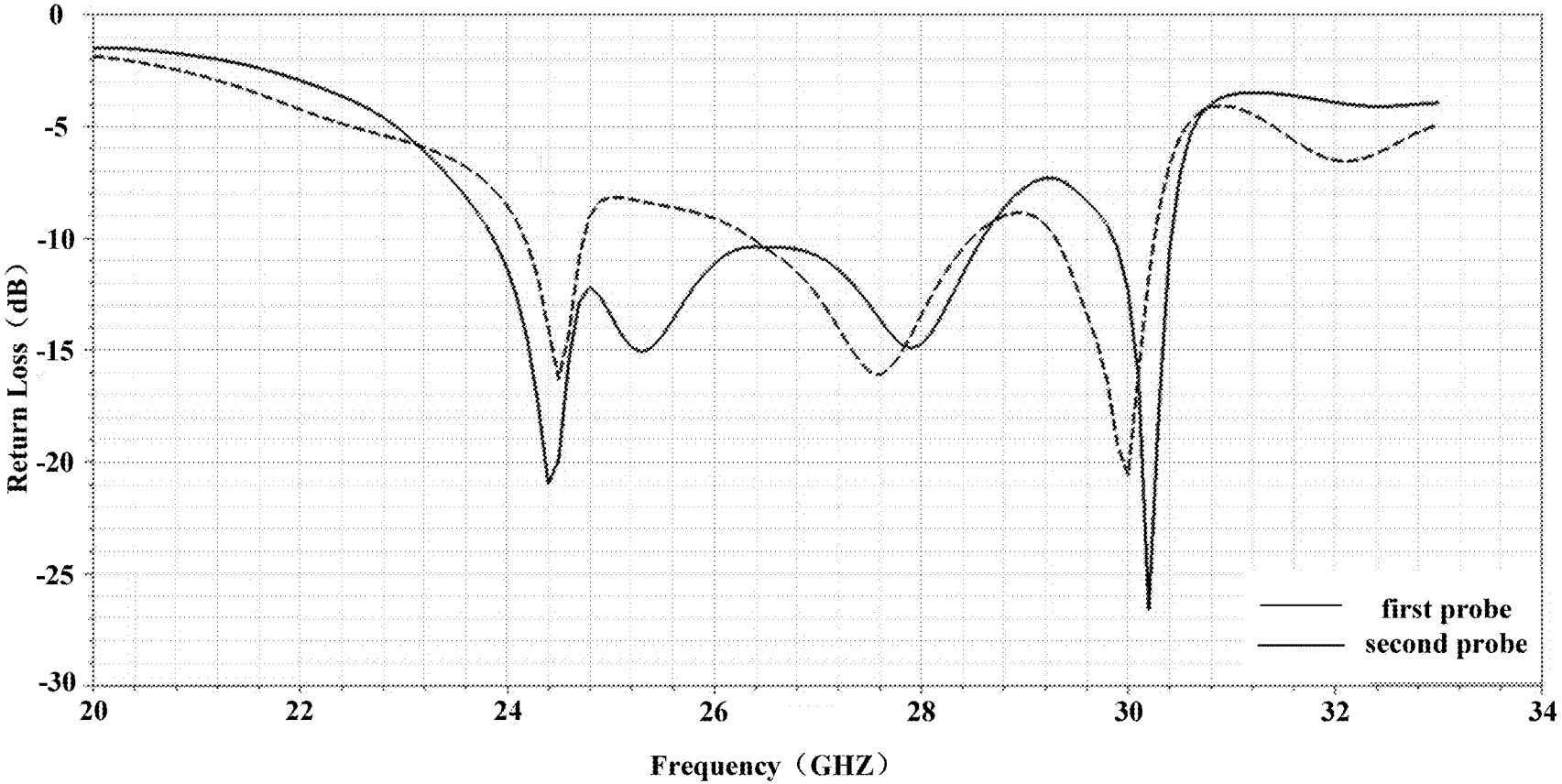
FIG. 8 is a diagram illustrating wideband impedance characteristic of a patch antenna unit according to an embodiment.

Referring to FIG. 8, FIG. 8 is a diagram illustrating wideband impedance characteristic of a patch antenna unit according to an embodiment.

FIG. 8 illustrates wideband impedance characteristic of an AiP structure in a polarization direction corresponding to the first probe and the second probe. In FIG. 8, a horizontal axis represents operation frequency of the AiP structure, and a vertical axis represents return loss. Specifically, in a frequency band of 24.25 GHz to 29.5 GHz, compared with the existing techniques, the AiP structure has better wideband impedance characteristic, and its return loss amplitude does not exceed −9 dB.

Figure 9:
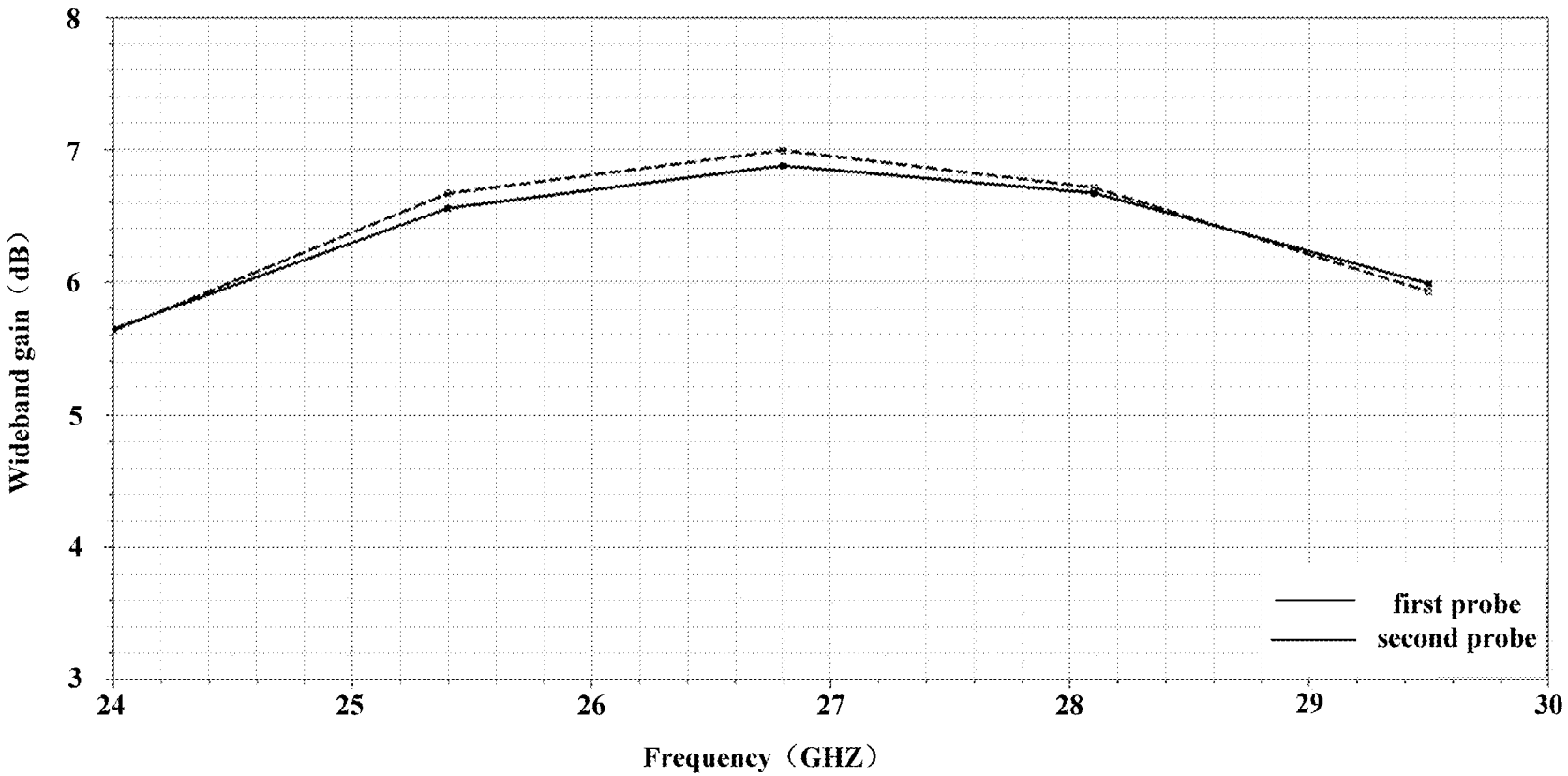
FIG. 9 is a diagram illustrating wideband gain characteristic of a patch antenna unit according to an embodiment.

Referring to FIG. 9, FIG. 9 is a diagram illustrating wideband gain characteristic of a patch antenna unit according to an embodiment.

FIG. 9 illustrates wideband gain characteristic of an AiP structure in a polarization direction corresponding to the first probe and the second probe. In FIG. 8, a horizontal axis represents operation frequency of the AiP structure, and a vertical axis represents wideband gain. Specifically, in a frequency band of 24.25 GHz to 29.5 GHz, compared with the existing techniques, the AiP structure has better wideband gain characteristic, and its radiation gain is not less than 5.6 dB.

Therefore, the AiP structure has better wideband impedance characteristic and wideband gain characteristic in this frequency band, thereby increasing the operation bandwidth, so as to meet communication requirements of user terminals in frequency bands N258 and N257.

In some embodiments, the AiP structure can also meet communication requirements in a frequency band of 24 GHz to 300 GHz, and has better performance than the existing techniques.

Under the premise of meeting the above performance specifications, the number of layers of a multi-layer substrate in the AiP structure may be designed to be less than 6, and thickness of the multi-layer substrate in the AiP structure may be designed to be less than 0.75 mm, which meets requirements of thin packaging.

As mentioned above, in the AiP structure provided in the embodiments of the present disclosure, function curve structures are used at aperture edges of patches to effectively expand an aperture field distribution in a plane direction, and different order function curves are used at apertures in different layers of patches. In this way, bandwidth of the antenna unit is expanded without increasing the thickness of the substrate, the thin and low-cost AiP structure reaches about 20% of the operation bandwidth and a dual-polarization operation mode with high isolation, which satisfies requirements of covering global frequency bands and polarization diversity.

Although the present disclosure has been disclosed above with reference to preferred embodiments thereof, it should be understood that the disclosure is presented by way of example only, and not limitation. Those skilled in the art can modify and vary the embodiments without departing from the spirit and scope of the present disclosure.

What is claimed is:

1. A patch antenna unit, comprising:

a base substrate or a printed circuit board;

multiple layers of patches stacked on the base substrate or the printed circuit board, wherein an isolation layer is disposed between adjacent layers of the patches, and configured to generate a radio frequency electromagnetic field, wherein an edge shape of at least one layer in the multiple layers of patches is a function curve shape, wherein edge shapes of all sides of a same layer in the multiple layers of patches are a same function curve shape, wherein a function curve corresponding to the function curve shape is $y(x)=A\cos(n\cdot 2\pi\cdot x/W)$ or $y(x)=A\sin(n\cdot 2\pi\cdot x/W)$, where W is a side length of an original rectangular patch, A is an amplitude of extension of a preset curve, and n is the number of cycles that the curve changes with edges of the patch.

2. The patch antenna unit according to claim 1, wherein edge shapes of sides of different layers in the multiple layers of patches are different function curve shapes.

3. An Antenna in Package (AiP) structure, which comprises a plurality of patch antenna units according to claim 1, and further comprises:

probes configured to feed power to a bottom patch of the plurality of patch antenna units; and a transceiver chip electrically connected to the plurality of patch antenna units through the probe, and configured receive or transmit signals within a preset frequency range.

* * * * *